United States Patent [19]

D'Alessio et al.

[11] 4,408,431

[45] Oct. 11, 1983

[54] SHORING EQUIPMENT

[75] Inventors: Michael S. D'Alessio, Flushing; Stanley A. Sandler, New York, both of N.Y.

[73] Assignee: Harsco Corporation, Camp Hill, Pa.

[21] Appl. No.: 225,204

[22] Filed: Jan. 15, 1981

[51] Int. Cl.[3] ..... E04G 1/06; E04G 1/22; E04H 12/08

[52] U.S. Cl. ..... 52/690; 52/637; 52/639; 182/179; 182/194

[58] Field of Search ..... 182/119, 178, 179, 194; 52/690, 179, 637, 638, 639; 29/DIG. 47; 405/272, 282; 248/188.2, 59, 73; 403/109; 160/309

[56] References Cited

U.S. PATENT DOCUMENTS

| | | | |
|---|---|---|---|
| 901,755 | 10/1908 | Tiepolt | 182/194 |
| 3,604,175 | 9/1971 | Gray | 52/637 |
| 3,850,264 | 3/1973 | Salinas | 182/179 |
| 4,238,164 | 12/1980 | Mazzolla | 403/109 |

FOREIGN PATENT DOCUMENTS

| | | | |
|---|---|---|---|
| 89075 | 4/1965 | France | 160/309 |

*Primary Examiner*—John E. Murtagh
*Assistant Examiner*—R. E. Chilcot
*Attorney, Agent, or Firm*—Curtis, Morris & Stafford

[57] ABSTRACT

An improved shoring frame adapted by a unique design to utilize relatively thin-walled aluminum tubing with a reasonable load-rating, be easily manufactured, and be compatible with existing steel accessories; where the extruded aluminum legs are each generally circular with a longitudinally-extending flattened portion for attaching struts and studs, and preferably having at least two internal ribs, circumferentially symmetrically-spaced relative to said flattened portion axially to contain accessories such as existing jack screws, extension legs, U-head fixtures, and the like.

18 Claims, 8 Drawing Figures

FIG. 4
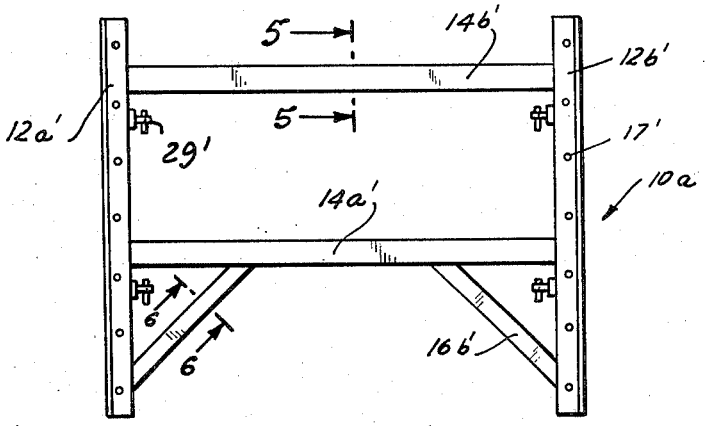
FIG. 5
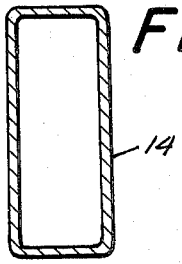
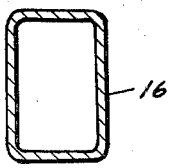
FIG. 6
FIG. 8
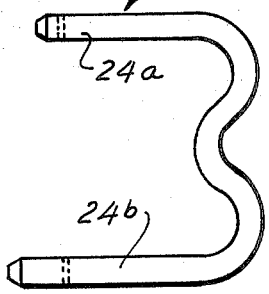
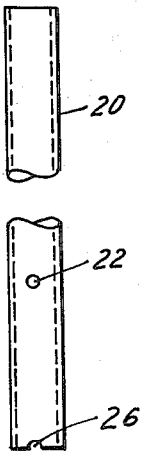
FIG. 7

SHORING EQUIPMENT

The present invention relates to an improved shoring system, and more particularly to a light-weight aluminum shoring frame useful with existing standard shoring equipment and accessories; all being of the general type commonly used in the construction and other related industries.

BACKGROUND OF THE INVENTION

Conventional shoring is made from stock steel tubing having a circular cross section of uniform thickness. The shoring frames and accessories are typically constructed by welding, or less desirably by mechanical fastening. The frames are cross-braced for assembly into support towers and the like. An example of such shoring, adopted for use with extendable frames, is illustrated in U.S. Pat. No. 3,190,405, issued June 22, 1965.

Aluminum has had some increasing use in the industry, although usually limited to special application scaffolding, flying shoring, or stationary joists. Aluminum is desirable because of its light weight and noncorrosiveness. However, its adaptation to some applications has required devising some particularly unique designs to realize the full potential of the advantages in its use.

For example, for medium-weight shoring applications, the large inventories of standardized complimentary equipment and accessories have not been compatible with the shoring frames constructed of aluminum rated to handle a reasonable compression loading. The aluminum frame legs were either too thick-walled, bulky and costly, or if sufficiently thin-walled were of too large a diameter and not adaptable to readily available standard accessories.

Additionally, welding of the aluminum causes technical problems in the de-rating of the columnar loading permissible due to the annealing effect of the welding in the construction of the aluminum frame.

Thus, it is an object of this invention to provide an aluminum shoring frame or the like that retains most of the advantages of the original steel equipment with the additional advantages of lightness and ease of handling resulting from the use of aluminum.

It is a further object to develop a shoring frame made primarily from an extrudable light-weight material of adequate strength and yet be competitively priced, given its advantages.

It is a still further object of the present invention to make maximum effective use of a minimum of material to minimize weight and material costs, without reducing load capacity.

Yet another object of the present invention is to provide a shoring frame structure which facilitates manufacturing by obviating the need for costly coping of strut to circular legs.

It is an additional object of the present invention to provide a shoring frame made from aluminum or similar light-weight material, which frame has a reasonable load capacity and yet is able to utilize existing standard equipment and accessories without specialized adaptors or the like.

BRIEF DESCRIPTION OF THE INVENTION

According to a preferred embodiment of the present invention, the legs of the shoring base frames are made from extruded hollow aluminum tubes having a generally circular cross section but with a longitudinally-extending flattened portion (which serves as a surface to which the frames' horizontal cross-struts are attached without coping). Such attachment is preferably by welding. Although welding will result in derating of the columnar load capacity of the welded leg, this can be compensated for within reason by increasing the wall thickness of the leg, modifying the bracing, and/or to a certain degree by increasing the diameter of the leg.

Preferably, each leg also has at least two longitudinally-extending indentations forming internal ribs (whose minimum radius is equal to the minimum radius of the flat portion of such leg). These ribs, together with said flat portion, serve to define at least three points spaced about the circumference of the leg for holding accessories such as screw legs centered within such legs. The advantage of this construction being the adaptation of the present structure to usefully employ already-existing conventional shoring accessories, while permitting larger diameter aluminum tubing to be used (thus resulting in greater load carrying capacity)—all without the necessity for special adaptor hardware or the like.

The innermost walls of said ribs and of said flattened portion are preferably defined by circular arcs generated by the aforementioned minimum radius. These circular arcs function to provide bearing or gripping surfaces for even more securely holding the standard accessories, which have at least a cylindrical portion of a predetermined size adapted to fit into the ends of current standard shoring legs.

The flat portion additionally has the advantage of serving as a convenient structure to which to attach studs for securing shoring cross bracing. Preferably these studs are made of steel secured to the aluminum legs by aluminum blocks (which aluminum blocks are welded to the legs and capture these steel studs therein mechanically—See FIG. 12 of co-pending application Ser. No. 185,761; filed Sept. 10, 1980. Alternatively, the steel stud may be threaded at one end and screwed into a drilled and tapped aluminum block.

The horizontal struts extending between the frame legs can be further braced by knee struts. Both of these can be made of box beams. Additionally, each of the legs can have equidistant holes drilled through each leg along the length thereof perpendicular to the plane of the frame. These holes are utilized for support pins for securing the lower end of an extension tube adapted to be positioned within said base frame leg. Two pins are used in order to spread the load transferred between the extension tube and the base frame leg; so that it does not all bear on a single pin position but is spread over two pin positions (this being preferable when utilizing a relatively softer metal, such as aluminum). Preferably a dual pin is used in place of two separate pins.

In this specification and the accompanying drawings, we have shown and described a preferred embodiment of our invention and have suggested various alternatives and modifications thereof, but it is to be understood that these are not intended to be exhaustive and that many other changes and modifications can be made within the scope of the invention. These suggestions herein are selected and included only for purposes of illustration in order that others skilled in the art will more fully understand the invention and the principles thereof and will thus be enabled to modify it and embody it in a variety of forms, each as may be best suited to the conditions of a particular use.

BRIEF DESCRIPTION OF THE DRAWINGS

FIG. 4 is an elevational view of a shorter frame but otherwise similar to the frame illustrated in FIG. 3;

FIG. 5 is a cross section taken as though along line 5—5 of FIG. 4 of a horizontal strut or rung of said shoring frame;

FIG. 6 is a cross-sectional view as though taken along line 6—6 in FIG. 4 of a knee brace or strut of said modified shoring frame;

FIG. 7 is an enlarged partial detail of an extension tube adapted to fit securely within a base frame leg of the type shown in FIG. 1; and FIG. 8 is a dual pin intended for use in securing the bottom of the extension tube of FIG. 7 in any of the adjacent holes in the base frame legs shown in FIGS. 1 through 4.

The medium-duty aluminum shoring frame embodying the present invention is generally erected and cross-braced in a manner generally similar to the heavy-duty aluminum shoring frames illustrated and claimed in the aforementioned co-pending application Ser. No. 185,761 (which is incorporated herein by reference).

If a medium-duty aluminum shoring frame were to be constructed of a thin-walled circular tubing, the necessary diameter would be too large to accommodate standard existing conventional shoring equipment. If the diameter of the aluminum tubing is made sufficiently small, then the wall thickness becomes prohibitively thick and costly. Applicant has developed a unique design for adapting the necessary larger diameter to a shape which accommodates the standard readily available smaller diameter accessory equipment and at the same time has the additional feature of providing a flat attachment surface for securing the frame struts to the frame legs (all while maintaining a reasonably large load rating, equipment versatility, and yet with a minimized amount of aluminum per unit length for cost savings).

This is accomplished by a shoring frame 10 having two frame legs 12*a* and 12*b* joined by horizontal struts 14*a*, 14*b* and 14*c*. As illustrated in FIG. 5, these rungs or horizontal struts 14 are preferably box beams, although more conventional round rungs or other variations can be employed. Similarly, the shoring frame 10 can be further stiffened by knee braces 16, See FIG. 6.

Figure 2:
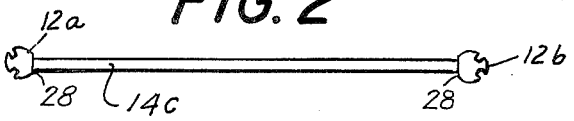
FIG. 2 is a plan view on a smaller scale of the frame partially illustrated in FIG. 1.
Figure 3:
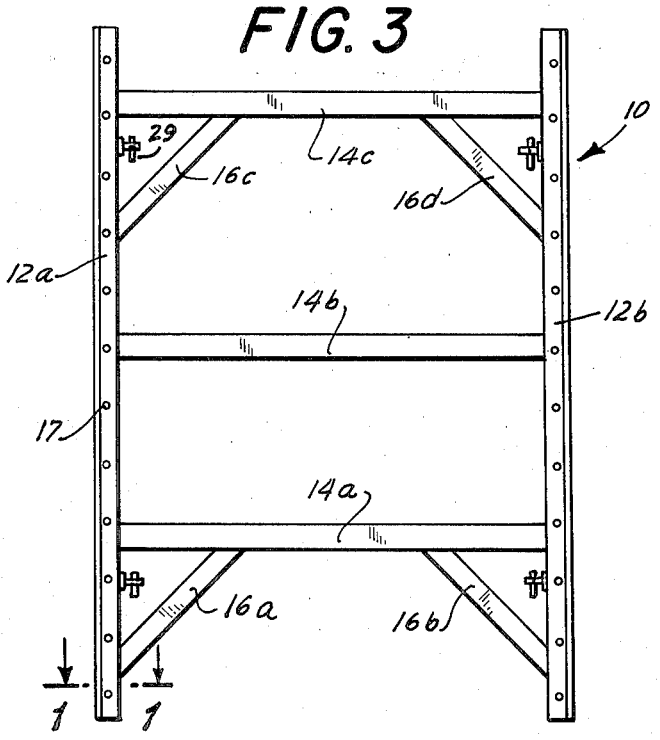
FIG. 3 is an elevational view of the frame illustrated in FIG. 2.

The frame 10 shown in FIG. 3 is of a typical height on the order of 6 feet. FIG. 4 illustrates a modification thereof showing a frame 10*a* of two thirds this standard height. Naturally, the frame can be manufactured in other heights as may be appropriate to a given need or rental inventory.

The frame legs 12 preferably have holes 17 drilled through the legs 12 at equal distances in a direction perpendicular to the plan which includes the frame legs 12 and struts 14 and 16. These holes 17 are intended for receiving support pins (which can be two separate standard pins or the dual pin 18 shown in FIG. 8). Extension tube 20 is dimensioned to fit securely within the base shoring frame leg 12. In the lower half of the extension tube 20 is provided at least one hole 22 for receiving a support pin (such as leg 24*a* of dual support pin 18). Preferably, the lower end of extension tube 20 has a semi-circular support recess 26 for mating with a second support pin such as leg 24*b* of pin 18 (see FIG. 7).

Figure 1:
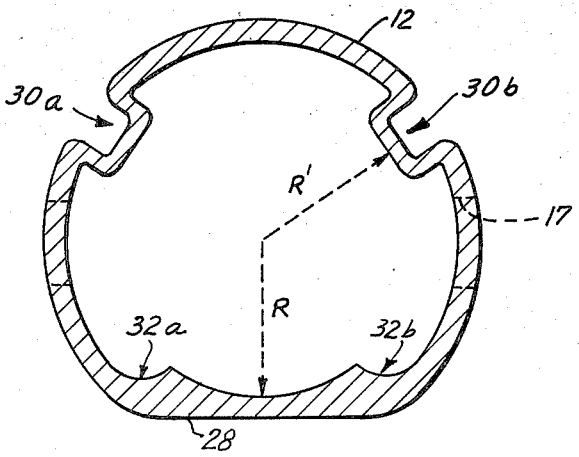
FIG. 1 is a cross section of a frame leg taken along line 1—1 in FIG. 3 illustrating a preferred embodiment of the present invention.

Referring to FIG. 1, in the preferred embodiment the leg 12 is substantially circular in cross section having a longitudinally-extending flattened portion 28 and two internally-directed ribs 30*a* and 30*b*.

The longitudinally-extending planar-surfaced wall proportion 28 advantageously presents a broad flat surface to which horizontal struts 14, knee struts 16, or other similar fixed bracing, or studs 29, can be attached without the need for coping a circular cut-out in the end of such struts etc. to mate with the circular leg 12. This flattening of the circular section of the leg 12 does somewhat diminish both the load capacity and the lateral strength of the leg, but this has been somewhat compensated for by thickening at least part of the flat portion (such as at 32). Such thickening of the walls at that point and possibly elsewhere may also be used to compensate for any annealing of the aluminum leg caused by welding if the struts are attached to the legs by welding rather than by mechanical means. Similar compensation may be accomplished by other methods such as by additional bracing.

The leg 12 in addition to the flat portion 28 preferably also has at least two internal ribs 30. The flat surface 28 and ribs 30 are spaced about the circumference of the leg 12 so as cooperatively to engage and preferably center any cylindrically shaped accessory, of a predetermined radius slightly less than R, which is inserted into the frame leg 12. This accessory can be an extension tube 20, a jack screw, a frame coupler (for permitting stacking of shoring frames one on another), a U-head fixture, and other similar equipment as will be understood by those skilled in the art. Preferably the flat surface 28 and the ribs 30 are substantially symmetrically spaced about the leg circumference to contain an accessory placed in the leg against lateral displacement and against vertical misalignment.

Preferably, the innermost surface of the flat portion 28 and the ribs 30 are equidistant from the center of the leg 12 by radius R. In other words, radius R equals radius R′.

Referring to FIG. 4, it will be appreciated that similar elements have been identified by the same reference numerals as utilized in the other figures, but differentiated by a prime (′).

We claim:

1. An improved shoring, scaffolding, or similar support frame made of relatively thin-walled extruded light weight metal tubing comprising at least a pair of parallel legs, fixed bracing means between said legs, each said leg being substantially circular in cross section with a longitudinally-extending planar-surfaced wall portion of a width to accommodate said bracing means and at least two longitudinally-extending internal ribs, the minimum inside radius of said leg to said planar wall portion and to each of said ribs being substantially the same and defining a circle which accommodates cylindrical accessories of a predetermined size, said ribs being substantially symmetrically spaced about the circumference of said leg relative to said wall portion sufficiently to contain each said accessory against lateral displacement and maintain it in longitudinal alignment, and said fixed bracing means being fixed to and between the respective planar-surfaced wall portions of said pair of legs.

2. A frame according to claim 1, wherein said frame is made principally from aluminum.

3. A frame according to claim 2, wherein said planar-surfaced wall portion has a width generally of the order of the length of the radius of said respective leg.

4. A frame according to claim 2, wherein said planar-surfaced wall portion is perpendicular to and symmetrical about said minimum radius of said leg to said portion.

5. A frame according to claim 4, wherein a substantial portion of the inner surfaces of said planar-surfaced wall portion and of said ribs are circular arcs defined by said minimum radius.

6. A frame according to claim 5, wherein said ribs are spaced about 110 degrees apart and symmetrically opposite said planar wall portion which latter subtends about 70 degrees.

7. A frame according to claim 5, wherein said bracing means comprise a plurality of spaced horizontal tubular struts each with squared ends welded to said respective planar-surfaced wall portions of said legs.

8. A frame according to claim 7, wherein said struts are made of box beams.

9. A frame according to claim 8, wherein said ribs are thin-walled U-shaped indentations in the circumference of each leg, having radiused edges.

10. A frame according to claim 9, wherein said legs have a plurality of equispaced holes oriented through each leg perpendicularly to the plane of said frame, said holes adapted to function as extension leg support pin holes.

11. A frame according to claim 10, further comprising a plurality of brace-receiving studs welded to said planar-surfaced wall portions near each end of each leg.

12. A frame according to claim 11 wherein each said stud comprises an aluminum block welded to said respective planar-surfaced wall portion, said block having a tapped hole therethrough generally perpendicular to the plane of said portion and a threaded stud seated in said block.

13. A frame according to claim 5, wherein said ribs are thin-walled U-shaped indentations in the circumference of each leg, having radiused edges.

14. A frame according to claim 13, wherein said legs have a plurality of equispaced holes oriented through each leg perpendicularly to the plane of said frame, said holes adapted to function as extension leg support pin holes.

15. A frame according to claim 5, wherein said legs have a plurality of equispaced holes oriented through each leg perpendicularly to the plane of said frame, said holes adapted to function as extension leg support pin holes.

16. A frame according to claim 15, further comprising a plurality of brace-receiving studs welded to said planar-surfaced wall portions near each end of each leg.

17. A frame according to claim 16, further comprising knee braces at the lower side at each end of at least one of said horizontal struts.

18. A frame according to claim 1, wherein said frame is made principally from magnesium.

* * * * *